US011919087B2

(12) United States Patent
Threadgill et al.

(10) Patent No.: US 11,919,087 B2
(45) Date of Patent: Mar. 5, 2024

(54) HOT ISOSTATIC PRESSING (HIP) FABRICATION OF MULTI-METALLIC COMPONENTS FOR PRESSURE-CONTROLLING EQUIPMENT

(71) Applicant: Schlumberger Technology Corporation, Sugar Land, TX (US)

(72) Inventors: Micah Threadgill, Cypress, TX (US); Terry Clancy, Cypress, TX (US); Herman Ernesto Amaya, Houston, TX (US); Christopher Nault, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 17/328,438

(22) Filed: May 24, 2021

(65) Prior Publication Data

US 2022/0184696 A1 Jun. 16, 2022

Related U.S. Application Data

(63) Continuation of application No. 17/123,186, filed on Dec. 16, 2020.

(51) Int. Cl.

| | |
|---|---|
| ***B22F 7/02*** | (2006.01) |
| ***B22F 3/15*** | (2006.01) |
| ***E21B 33/06*** | (2006.01) |

(52) U.S. Cl.

CPC ..... *B22F 7/02* (2013.01); *B22F 3/15* (2013.01); *E21B 33/063* (2013.01); *B22F 2301/15* (2013.01); *B22F 2301/35* (2013.01)

(58) Field of Classification Search

CPC ..... B22F 7/02; B22F 3/15; B22F 2301/15; B22F 2301/35; E21B 33/063;

(Continued)

(56) References Cited

U.S. PATENT DOCUMENTS 4,477,955 A ‡ 10/1984 Becker ..... B22F 7/08 419/48
4,540,046 A * 9/1985 Granger ..... E21B 33/063 166/55

(Continued)

FOREIGN PATENT DOCUMENTS

CN 209163772 ‡ 7/2019
EP 0740589 A1 11/1996

(Continued)

OTHER PUBLICATIONS

ASM (Ultrahigh-Strength Steels, ASM Handbook, vol. 1990) (Year: 1990).*

(Continued)

*Primary Examiner* — Ricardo D Morales
(74) *Attorney, Agent, or Firm* — Jeffrey D. Frantz

(57) ABSTRACT

A multi-metallic pressure-controlling component and a hot isostatic pressure (HIP) manufacturing process and system are disclosed. An example multi-metallic ram includes a first portion formed from a first metal alloy, a second portion formed from a second metal alloy, and a diffusion bond at an interface between the first metal alloy and the second metal alloy that joins the first metal alloy to the second metal alloy within the multi-metallic ram.

17 Claims, 8 Drawing Sheets

(58) Field of Classification Search
CPC .... E21B 33/061; E21B 33/062; E21B 33/064; E21B 33/068; E21B 33/076
See application file for complete search history.

(56) References Cited

U.S. PATENT DOCUMENTS

| | | | | |
|---|---|---|---|---|
| 5,815,790 | A | 9/1998 | Billgren | |
| 6,110,418 | A | 8/2000 | Jablonski | |
| 8,168,306 | B2 * | 5/2012 | Ayer | B23K 35/3046 219/60 R |
| 11,471,943 | B2 | 10/2022 | Berglund | |
| 2006/0266801 | A1 ‡ | 11/2006 | Tonks | B23K 20/021 228/101 |
| 2008/0078081 | A1 ‡ | 4/2008 | Huff | E21B 33/062 29/890.124 |
| 2010/0003540 | A1 | 1/2010 | Koseki | |
| 2011/0147623 | A1 * | 6/2011 | Hall | E21B 33/063 251/1.3 |
| 2013/0153204 | A1 ‡ | 6/2013 | Carbaugh | E21B 33/063 166/85.4 |
| 2016/0318118 | A1 | 11/2016 | Strandell | |
| 2016/0318119 | A1 | 11/2016 | Strandell | |
| 2017/0058628 | A1 * | 3/2017 | van Wijk | F16K 3/314 |
| 2017/0175905 | A1 ‡ | 6/2017 | Martino | B22F 5/10 |
| 2018/0355464 | A1 | 12/2018 | Imundo, Jr. | |
| 2019/0160602 | A1 | 5/2019 | Santacreu | |
| 2020/0072013 | A1 ‡ | 3/2020 | Smith | E21B 33/061 |

FOREIGN PATENT DOCUMENTS

| | | | | |
|---|---|---|---|---|
| EP | 2236229 | B1 | 7/2015 | |
| EP | 2236229 | B1 ‡ | 7/2015 | |
| EP | 3335820 | A2 | 6/2018 | |
| EP | 3335820 | A2 * | 6/2018 | B22F 3/15 |
| EP | 3335820 | A3 | 7/2018 | |
| EP | 3335820 | A3 ‡ | 7/2018 | B22F 3/15 |
| EP | 3502297 | A1 | 6/2019 | |
| JP | S5798602 | A | 6/1982 | |
| JP | S61144229 | A | 7/1986 | |
| WO | 2010053431 | A1 | 5/2010 | |
| WO | 2020022464 | A1 | 1/2020 | |
| WO | WO-2020022464 | A1 ‡ | 1/2020 | B23K 20/023 |

OTHER PUBLICATIONS

Azom ("W1 Tool Steel-Water-Hardenino Tool Steel (UNS -72301)" Jul. 16, 2013, AZoNetwork. Accessed Aug. 22, 2022) (Year: 2013).*

Butrim et al. ("Experience in HIP diffusion welding of dissimilar metals and alloys." Proceedings of 12th International Conference on Hot Isostatic Pressing—HIP. vol. 17. 2019.) (Year: 2019).*

Lindwall et al., "Experimental and Theoretical Investigations of Hot Isostatically Pressed-Produced Stainless Steel/High Alloy Tool Steel Compound Materials", Metallurgical and Materials Transactions, vol. 42A, May 2011, pp. 1165-1172.‡

International Search Report and Written Opinion issued in International Patent application PCT/US2021/072935 dated Apr. 11, 2022, 10 pages.‡

Jacobs, "Surface engineering of materials", Materials & Design, Jan. 1, 1993, vol. 14, No. 1, pp. 33-37.

International Preliminary Report on Patentability issued in PCT Application No. PCT/US2021/072935 dated Jun. 29, 2023, 7 pages.

* cited by examiner
‡ imported from a related application

HOT ISOSTATIC PRESSING (HIP) FABRICATION OF MULTI-METALLIC COMPONENTS FOR PRESSURE-CONTROLLING EQUIPMENT

CROSS-REFERENCE TO RELATED APPLICATION

This application is a continuation of U.S. application Ser. No. 17/123,186, filed on Dec. 16, 2020, and entitled "HOT ISOSTATIC PRESSING (HIP) FABRICATION OF MULTI-METALLIC COMPONENTS FOR PRESSURE-CONTROLLING EQUIPMENT," which is hereby incorporated by reference in its entirety for all purposes.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

A blowout preventer (BOP) is installed on a wellhead to seal and control an oil and gas well during various operations. For example, during drilling operations, a drill string may be suspended from a rig through the BOP into a wellbore. A drilling fluid is delivered through the drill string and returned up through an annulus between the drill string and a casing that lines the wellbore. In the event of a rapid invasion of formation fluid in the annulus, commonly known as a "kick," the BOP may be actuated to seal the annulus and to contain fluid pressure in the wellbore, thereby protecting well equipment positioned above the BOP.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

Figure 1:
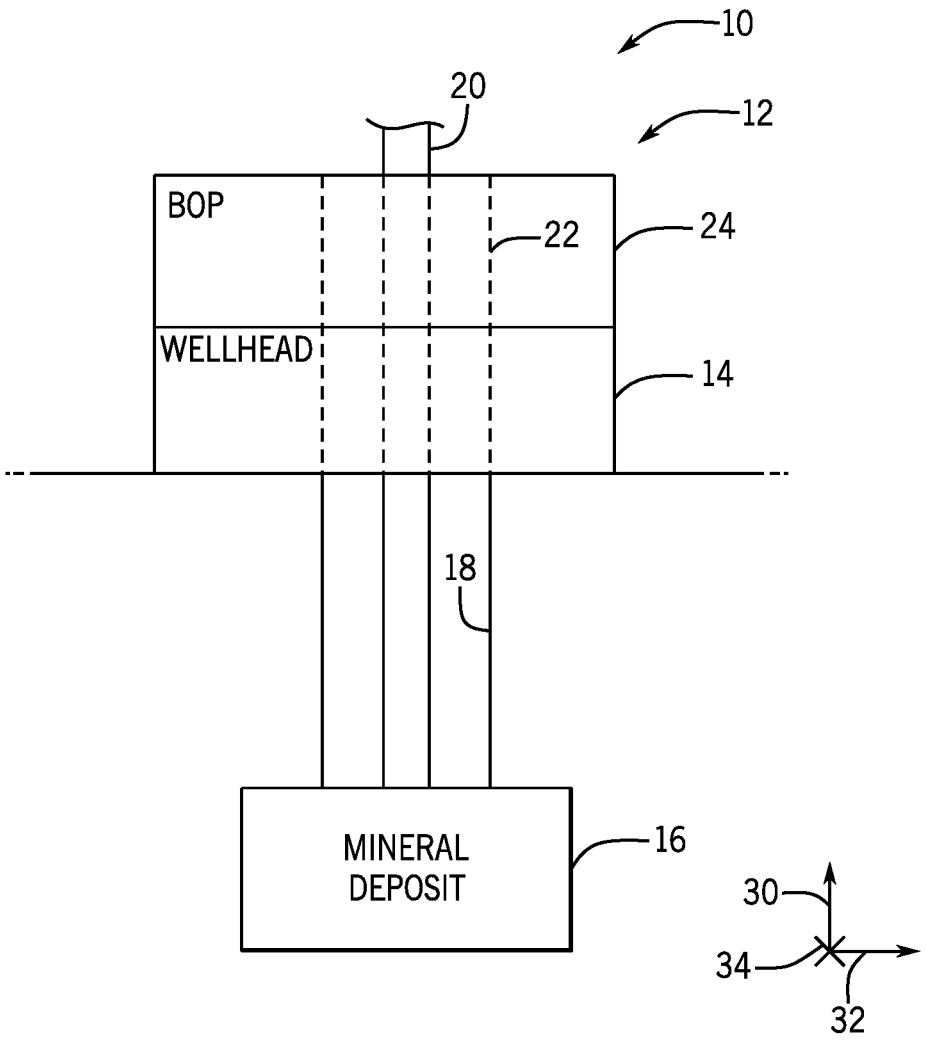
FIG. 1 is a block diagram of a drilling system for mineral extraction, in accordance with an embodiment of the present disclosure.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Present embodiments are generally directed to systems and methods for the hot isostatic pressing (HIP) fabrication of components for use in the oil field services industry, which may relate generally to any activities (e.g., drilling, producing, monitoring, and/or maintaining) that facilitate access to and/or extraction of natural resources (e.g., hydrocarbons) from the earth. The components may be any of a variety of components for use in equipment, such as pressure-containing and/or pressure-controlling equipment. Present embodiments enable the production of multi-metallic (e.g., bimetallic, trimetallic) components, such as pressure-containing components and/or pressure-controlling components. An example embodiment includes a HIP-fabricated multi-metallic ram of a blowout preventer (BOP). A traditional BOP ram is fabricated using a subtractive manufacturing technique in which a forged block of a particular metal alloy is precisely machined into a complex shape, and then a number of conventional and unconventional heat treatments are performed to impart different material properties to different portions of the part. As used herein, the term metal alloy refers to either a pure metal or a metallic solid solution including a number of different metallic and/or non-metallic chemical elements.

In contrast, present embodiments involve the use of a HIP-fabrication process in which different metal alloys (e.g., different metal alloy powders, different metal alloy boundary layers) are combined and sealed in a canister before being heated and pressurized during a HIP process (e.g., in an autoclave) to form a multi-metallic pressure-controlling component (e.g., a BOP ram). As a result, the different metal alloys are disposed in different portions of the part to impart different material properties to these portions of the part (e.g., higher strength and hardness in a blade area of the ram, higher toughness in the body of the ram). Additionally, a finite (e.g., narrow) diffusion bond forms at the interface between different metal alloys, yielding a dense, seamless pressure-controlling component.

It is presently recognized that the disclosed HIP manufacturing process enables substantially greater freedom of design by enabling the joining of metal alloys that may be chemically incompatible using traditional joining methods (e.g., welding). Additionally, by using different metal alloys in different portions of the part, a greater range of material properties (e.g., strength, toughness, ductility, hardness, corrosion resistance) is available compared to the range of material properties achievable using a traditional, single metal alloy ram with multiple thermal processing steps. Within the HIP manufacturing process, a HIP process chemically bonds powder metal into a solid part under "extreme" temperature and pressure. After the HIP process is complete, the final part may be achieved with reduced processing time, compared with the traditional manufacturing techniques. For example, after the HIP process has been applied to join the metal powders of the multi-metallic part, the final part may be realized with reduced machining time, with little or no welding, and without special heat treatment processes of traditional manufacturing techniques, thereby reducing manufacturing time and cost relative to traditional manufacturing techniques. Furthermore, the disclosed HIP manufacturing process generally provides the capability to efficiently construct pressure-controlling equipment components having a complex shape while avoiding or reducing time-consuming and/or costly complex thermal processing, welding, and/or machining steps.

While the present embodiments are described in the context of a ram of a BOP for a drilling system to facilitate discussion, it should be appreciated that the systems and methods for HIP fabrication of multi-metallic components may be adapted for fabrication of other equipment, such as another component of the BOP for the drilling system and/or another component of another device for any type of system (e.g., drilling system, production system).

With the foregoing in mind, FIG. 1 is a block diagram of an embodiment of a drilling system 10 for mineral extraction. The drilling system 10 may be configured to drill (e.g., circulate drilling mud and take drilling cuttings up to surface) for the eventual extraction of extract various minerals and natural resources, including hydrocarbons (e.g., oil and/or natural gas), from the earth and/or to inject substances into the earth. The drilling system 10 may be a land-based system (e.g., a surface system) or an offshore system (e.g., an offshore platform system).

As shown, a BOP stack 12 may be mounted to a wellhead 14, which is coupled to a mineral deposit 16 via a wellbore 18. The wellhead 14 may include or be coupled to any of a variety of other components such as a spool, a hanger, and a "Christmas" tree. The wellhead 14 may return drilling fluid or mud toward a surface during drilling operations, for example. Downhole operations are carried out by a conduit 20 (e.g., drill string) that extends through a central bore 22 of the BOP stack 12, through the wellhead 14, and into the wellbore 18.

As discussed in more detail below, the BOP stack 12 may include one or more BOPs 24 (e.g., ram BOPs), and component (e.g., rams) of the one or more BOPs 24 may be manufactured using systems and methods for HIP fabrication disclosed herein. To facilitate discussion, the BOP stack 12 and its components may be described with reference to a vertical axis or direction 30, an axial axis or direction 32, and/or a lateral axis or direction 34.

Figure 2:
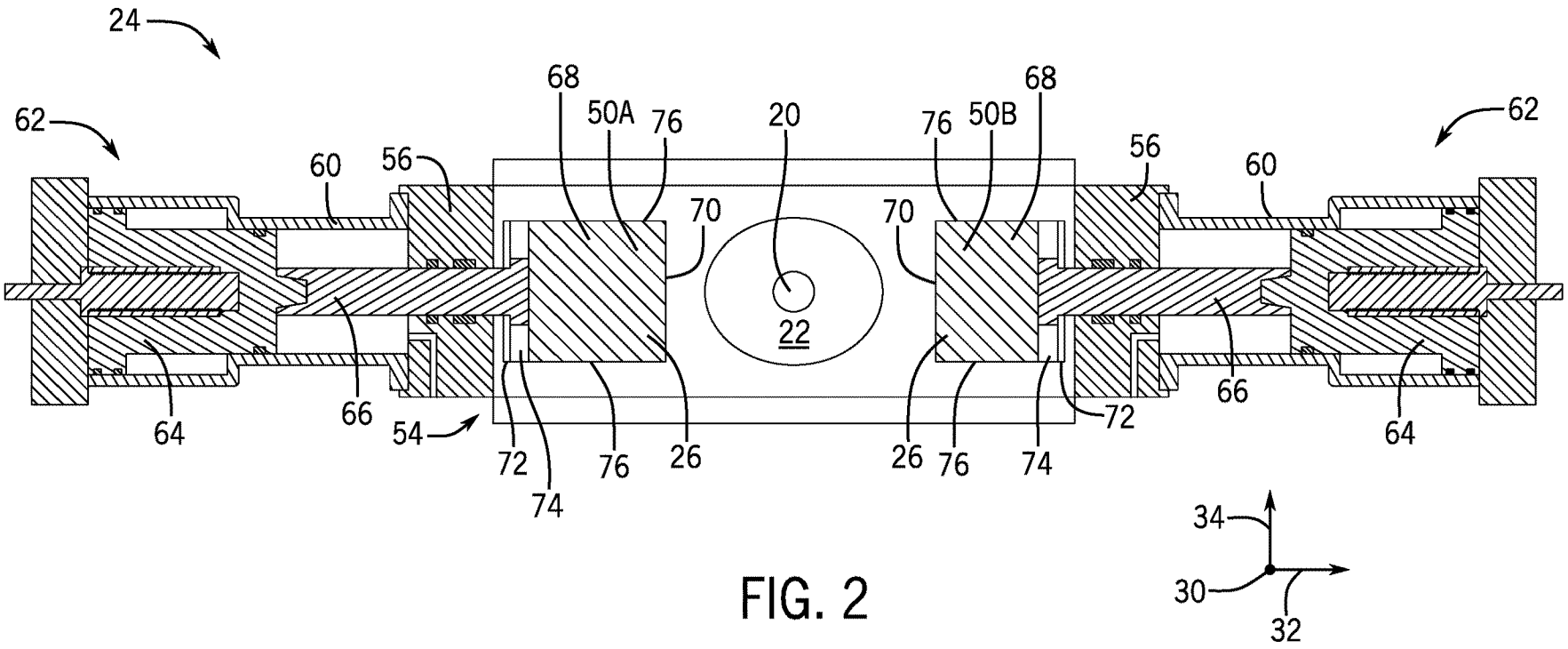
FIG. 2 is a cross-sectional top view of a portion of a blowout preventer (BOP) that may be used in the drilling system of FIG. 1, in accordance with an embodiment of the present disclosure.

FIG. 2 is a cross-sectional top view of a portion of an embodiment of the BOP 24 that may be used in the drilling system 10 of FIG. 1, in accordance with an embodiment of the present disclosure. As shown, the BOP 24 includes opposed rams 50, including upper ram 50A and lower ram 50B, also generally referred to herein as pressure-controlling components 26 or multi-metallic pressure-controlling components 26 of the BOP 24. In the illustrated embodiment, the opposed rams 50 are in an open configuration 54 of the BOP 24 in which the opposed rams 50 are withdrawn from the central bore 22, do not contact the conduit 20, and/or do not contact one another.

As shown, the BOP 24 includes a bonnet flange 56 surrounding the central bore 22. The bonnet flange 56 is generally rectangular in the illustrated embodiment, although the bonnet flange 56 may have any cross-sectional shape, including any polygonal shape and/or annular shape. Bonnet assemblies 60 are mounted on opposite sides of the bonnet flange 56 (e.g., via threaded fasteners). Each bonnet assembly 60 includes an actuator 62, which may include a piston 64 and a connecting rod 66. The actuators 62 may drive the opposed rams 50 toward one another along the axial axis 32 to reach a closed position in which the opposed rams 50 are positioned within the central bore 22, contact and/or shear the conduit 20 to seal the central bore 22, and/or contact one another to seal the central bore 22.

Each of the opposed rams 50 may include a body section 68 (e.g., ram body), a leading surface 70 (e.g., side, portion, wall) and a rearward surface 72 (e.g., side, portion, wall, rearmost surface). The leading surfaces 70 may be positioned proximate to the central bore 22 and may face one another when the opposed rams 50 are installed within the housing 56. The rearward surfaces 72 may be positioned distal from the central bore 22 and proximate to a respective one of the actuators 62 when the opposed rams 50 are installed within the housing 56. The leading surfaces 70 may be configured to couple to and/or support sealing elements (e.g., elastomer or polymer seals) that are configured to seal the central bore 22 in the closed position, and the rearward surfaces 72 may include an attachment interface 74 (e.g., recess) that is configured to engage with the connecting rod 66 of the actuator 62. The body section 68 also includes lateral surfaces 76 (e.g., walls) that are on opposite lateral sides of the body section 68 and that extend along the axial axis 32 between the leading surface 70 and the rearward surface 72. In FIG. 2, the opposed rams 50 have a generally rectangular shape to facilitate discussion; however, it should be appreciated that the opposed rams 50 may have any of a variety of shapes or features (e.g., curved portions to seal against the conduit 20, edges to shear the conduit 20).

Figure 3:
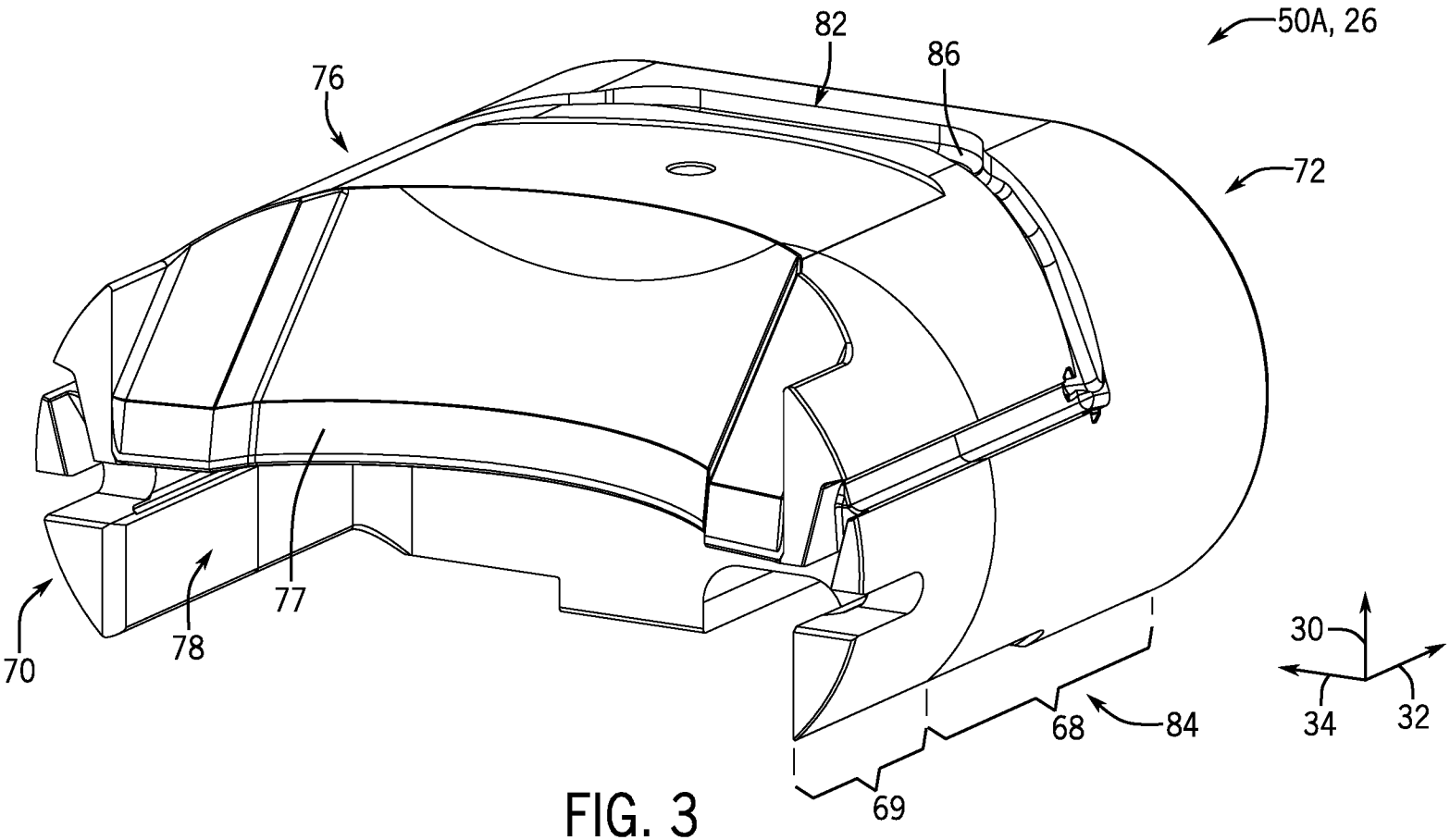
FIG. 3 is a front isometric view of a component, namely an upper ram, that may be used in the BOP of FIG. 2, in accordance with an embodiment of the present disclosure.
Figure 4:
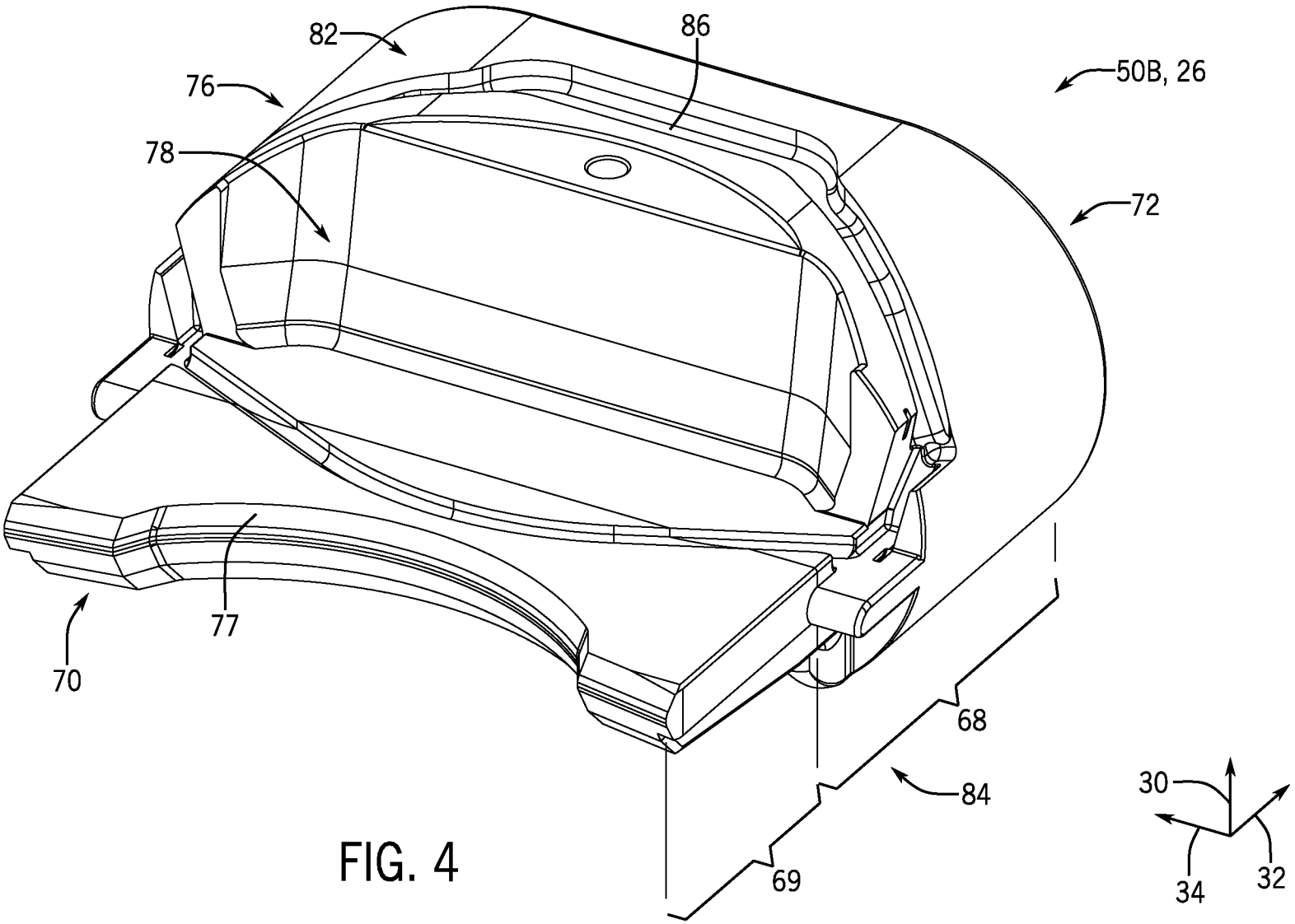
FIG. 4 is a front isometric view of another component, namely a lower ram, that may be used in conjunction with the upper ram of FIG. 3 and the BOP of FIG. 2, in accordance with an embodiment of the present disclosure.

FIG. 3 is a front isometric view of an embodiment of the upper ram 50A, and FIG. 4 is a front isometric view of an embodiment of the lower ram 50B, which may be used together as pressure-controlling components 26 in the embodiment of BOP 24 of FIG. 2. As illustrated in FIGS. 3 and 4, the pressure-controlling components 26 each include the body section 68 and a blade section 69. Each blade section 69 includes the leading surface 70, while the body section 68 includes the rearward surface 72 of the rams 50. Because the rams 50 of FIGS. 3 and 4 are shear rams, each blade section 69 includes a respective edge portion 77 that is formed in the leading surface 70 and that extends along the lateral axis 34 of each of the rams 50. In a closed configuration, the respective edge portions 77 of the upper ram 50A and the lower ram 50B are configured to shear the conduit 20 and/or support the seal elements that seal against the central bore 22 of the BOP illustrated in FIG. 2. However, it should be appreciated that the rams 50 may have any of a variety of other configurations (e.g., the rams 50 may be pipe rams that lack the respective edge portions 77). The blade section 69 of each of the rams 50 of FIGS. 3 and 4 also includes a leading cutout 78 formed in the leading surfaces 70 (e.g., positioned above and below the respective edge portion 77 along the vertical axis 30). The leading surface 70, the rearward surface 72, the lateral surfaces 76, a top surface 82 (e.g., top-most surface), and a bottom surface 84 (e.g., bottom-most surface) may be considered the respective outer surfaces of the rams 50. For the illustrated rams 50, the outer surfaces include grooves or channels 86. In certain embodiments, at least a portion of these grooves may be sealing grooves designed to receive or interface with a polymeric material (e.g., an elastomeric seal), while a portion of these grooves may be sliding grooves designed to receive a slide along a metallic extension during operation of the BOP.

For the pressure-controlling components 26 illustrated in FIGS. 3 and 4, at least the body section 68 and the blade section 69 have a different metal alloy composition (e.g., a different chemical composition). For example, in certain embodiments, the body section 68 of the rams 50 may be made of a first metal alloy, while at least a portion of the blade section 69 (e.g., an outer surface) is made of a second metal alloy. The various metal alloys of the pressure-controlling components 26 may be selected for desirable material properties, including but not limited to: toughness, percent elongation, percent reduction of area, tensile strength, yield strength, impact strength, ductility, hardness, and corrosion resistance. A non-limiting list of example metal alloys includes, but is not limited to: chromium-molybdenum (Cr—Mo) steels (e.g., Unified Numbering System (UNS) G41300, UNS G41400, UNS K21590); chromium-nickel-molybdenum (Cr—Ni—Mo) steels (e.g., UNS G43400); maraging (also known as martensitic-aged) steels (e.g., UNS K91973, UNS K44220, UNS K93120); super martensitic stainless steels (e.g., Euronorm (EN) 1.4418, UNS S41425, UNS S41426, UNS S41427); precipitation-hardened nickel alloys (e.g., UNS N07718, UNS N09946); precipitation-hardened martensitic steels (e.g., UNS S35000, UNS S17400); solution-annealed nickel alloys (e.g., UNS N06625, UNS N08825); tool steels (e.g., UNS T41907, UNS T30402, UNS T20813); cobalt or nickel-bound tungsten-carbides, nickel-cobalt (Ni—Co) alloys (e.g. UNS R30035); and cobalt-chromium (Co—Cr) alloys (e.g. UNS R30006). In certain embodiments, one or more of the metal alloys of the pressure-controlling components 26 may be compliant with the National Association of Corrosion Engineers (NACE) MR0175 standard (also referred to as ISO 15156), which is a materials standard intended to assess the suitability of materials for oil and gas applications in which where sulfide stress corrosion cracking may be a risk in hydrogen sulfide-rich (sour) environments.

Figure 5:
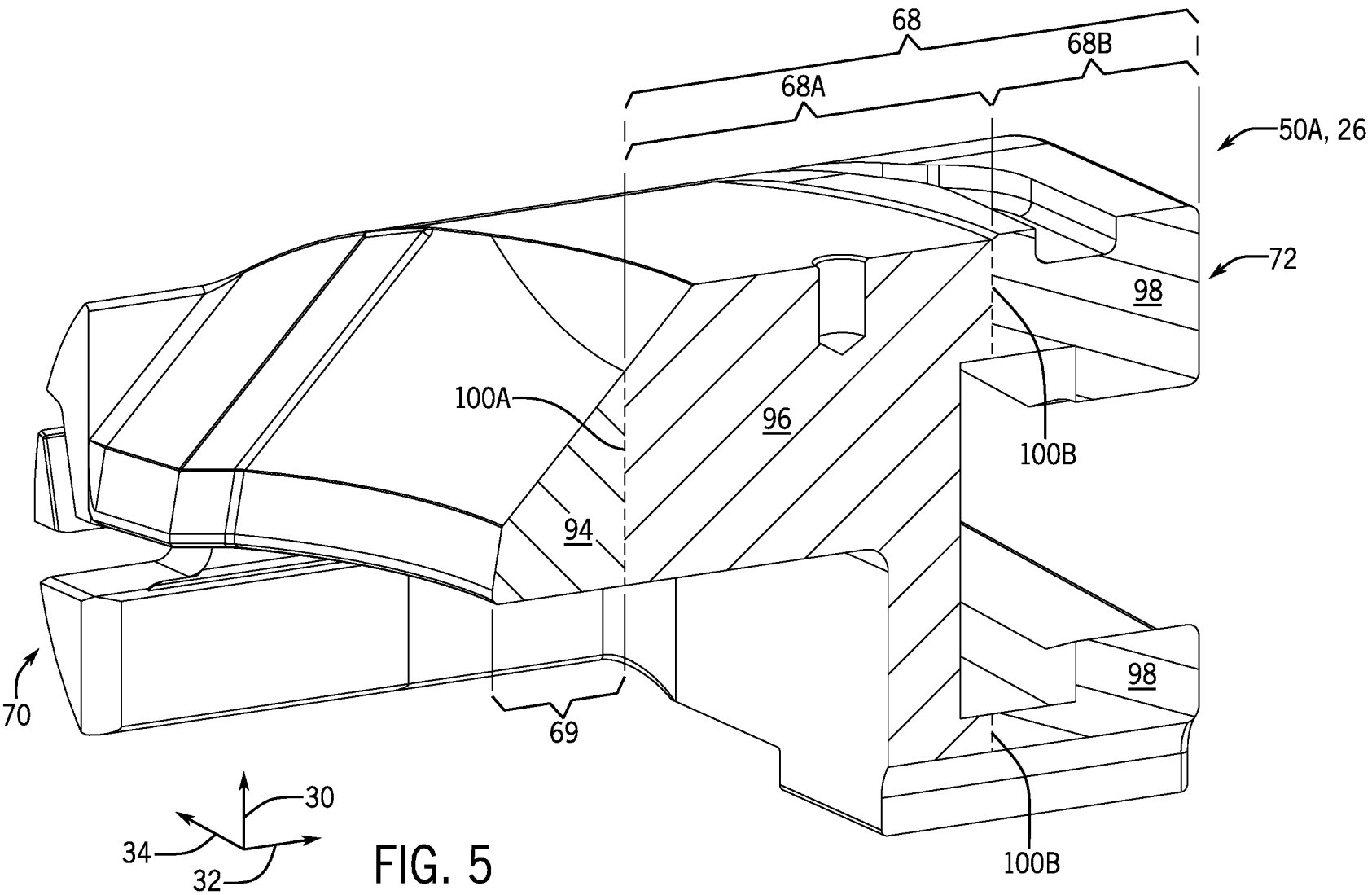
FIGS. 5, 6, 7, and 8 are cross-sectional views of the components of FIGS. 3 and 4, in accordance with various embodiments of the present disclosure.

FIG. 5 is a cross-sectional view of an embodiment of the upper ram 50A illustrated in FIG. 3. For the illustrated embodiment, the blade section 69 of illustrated upper ram 50A is made of a first metal alloy 94. The body section 68 includes a first portion 68A that is made of a second metal alloy 96 and a second portion 68B that is made of a third metal alloy 98, resulting in a substantially trimetallic upper ram 50A. In some embodiments, both portions of the body section 68 may only include a single metal alloy, resulting in a substantially bimetallic upper ram 50A, in which the blade section 69 and the body section 68 each are made entirely of a different respective metal alloy.

The metal alloys of the pressure-controlling component 26 (e.g., metal alloys 94, 96, 98) may be selected based on a number of criteria. For example, for the embodiment illustrated in FIG. 5, it may be desirable for the blade section 69 to have a greater strength (e.g., a tensile and/or yield strength that is at least 5 percent greater, at least 10 percent greater, at least 20 percent greater, 200 percent greater, 250 percent greater, 300 percent greater) than that of the body section 68. Additionally or alternatively, it may be desirable for the body section 68 to have a greater toughness (e.g., a percent elongation and/or percent reduction in area that is at least 5 percent greater, at least 10 percent greater, at least 20 percent greater, 200 percent greater, 250 percent greater, 300 percent greater) than that of the blade section 69. This can result in the formation of rams 50 having a stronger blade section 69, while also having a tougher, more ductile, and more resilient body section 68.

As such, for the embodiment illustrated in FIG. 5, the first metal alloy 94 that forms the blade section 69 may be selected based on having a suitably higher strength relative to the second metal alloy 96 that forms at least a substantial portion of the body section 68. For embodiments that include the second boundary and the third metal alloy 98, the third metal alloy may be selected based on having a higher corrosion resistance relative to the second metal alloy 96. For example, in an example embodiment, the blade section 69 may be formed using a high-alloy steel alloy 94, which has relatively higher strength; the first portion 68A of body section 68 may be formed using low-alloy steel 96, which has a relatively higher toughness; and the second portion 68B of the body section 68 may be formed using a high-chrome or high-nickel steel 98, which has relatively higher corrosion resistance. While corrosion resistance may be desirable when the second portion 68B of the body section 68 will contact a elastomer or polymer seal, for embodiments in which the second portion 68B will contact and slide against a metallic surface during operation, the second portion 68B may instead be formed from a metal alloy having a relatively greater hardness (e.g., at least 5 percent greater hardness, at least 10 percent greater hardness), which can improve sliding against the metallic part (e.g., reducing or preventing galling, reducing wear). Additionally, the selected metal alloys should be compatible with one another for the HIP process. In other words, in certain embodiments, certain material properties of the selected metal alloys (e.g., melting point, sintering point) should be similar (e.g., within a predetermined threshold), such that simultaneous, preferential microstructural develops in each material during a single HIP process, as discussed below.

Additionally, the embodiment of the upper ram 50A illustrated in FIG. 5 includes planar (e.g., straight, flat) boundaries or interfaces 100, at which the two different metal alloys meet and join via a narrow (e.g., less than 5 millimeter, less than 3 millimeter, about 1 millimeter) diffusion bond, which may also be referred to as the diffusion bond zone. For the embodiment of FIG. 5, these boundaries 100 include a first boundary 100A disposed between the blade section 69 and the first portion 68A of the body section 68, as well as a second boundary 100B disposed between the first portion 68A and the second portion 68B of the body section 68. For the illustrated embodiment, the boundaries 100 are aligned with planes oriented in the vertical and lateral directions (e.g., along a plane defined by axes 30 and 34). In certain embodiments, as discussed below, a thin boundary layer may be present along the interface 100 and be made of a metal alloy that is the same as or different from the metal alloys present on either side of the boundaries 100. For clarity, since the boundary layer contributes little to the overall composition of the upper ram 50A, the upper ram 50A illustrated in FIG. 5 may be described herein as being "substantially trimetallic," meaning that it predominantly includes only metal alloys 94, 96, and 98, even when boundary layers are used having different compositions relative to the metal alloys 94, 96, and 98.

It may be appreciated that, for certain embodiments of pressure-controlling components 26, it may be desirable for the diffusion bonds at the boundaries 100 to demonstrate certain features or material properties. For example, in certain embodiments, the strength (e.g., tensile strength, yield strength) at each interface 100 between different metal alloys is greater than the strength of the material that is used to form at least a substantial portion of the body 68. For the embodiment of FIG. 5, this would mean that the diffusion bond at the boundary 100 between the blade section 69 and the body section 68 would have a greater strength than that of the metal alloy 96 that forms the bulk of the body section 68. It may also be desirable, in certain embodiments, for the sintering of the metal alloys at and/or near the boundary 100, and therefore the resulting grain structure, to be substantially homogenous. In certain embodiments, it may be desirable that the integrity of the body between the different metal alloys to be stable and maintained through any heating and quenching processes used in the fabrication of the pressure-controlling components 26.

Figure 6:
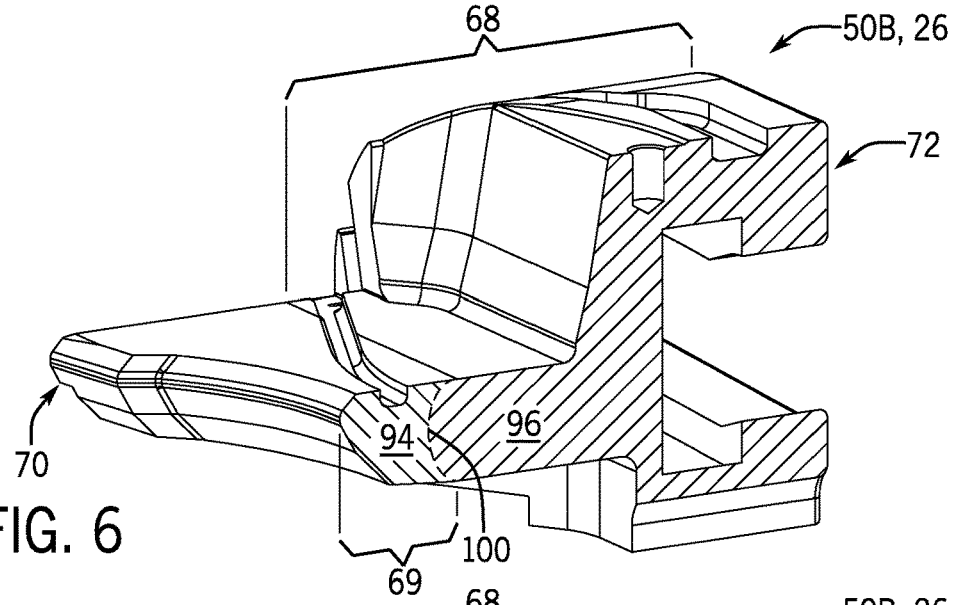
Figure 7:
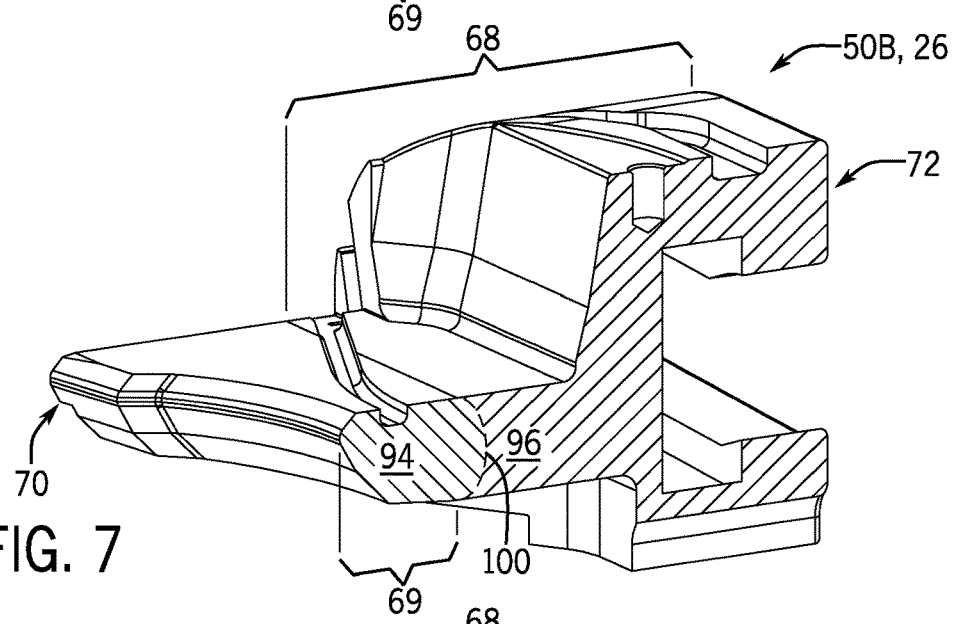

In some embodiments, the boundaries 100 that define the diffusion bonds between the different metal alloys of the pressure-controlling components 26 may not be planar boundaries. For example, FIGS. 6 and 7 are cross-sectional views of embodiments of substantially bimetallic lower rams 50B having a curved boundary 100 (e.g., a curved diffusion bond) disposed between a first metal alloy 94 and a second metal alloy 96 that form the lower ram 50B. In FIG. 6, the curved boundary 100 results in the blade section 69 having both the first and the second metal alloys, while the curved boundary in FIG. 7 results in the body section 68 having both the first and the second metal alloys. In certain embodiments, it may be desirable to use the curved boundary 100, as opposed to the planar boundaries discussed above, to reduce the amount of the first alloy 94 or the second alloy 96 used to make the pressure-controlling component 26. In some embodiments, it may be desirable to include the curved boundary 100 increase the surface area of the interface 100 (e.g., the surface area of the diffusion bond) between the first and second metal alloys 94, 96 to enhance the material properties (e.g., strength, toughness) of the pressure-controlling component 26 at the interface 100. Additionally, while regular curved boundaries are illustrated, in some embodiments, the boundaries 100 may have substantial irregularity (e.g., ripples, undulations) without departing from the techniques disclosed herein.

Figure 8:
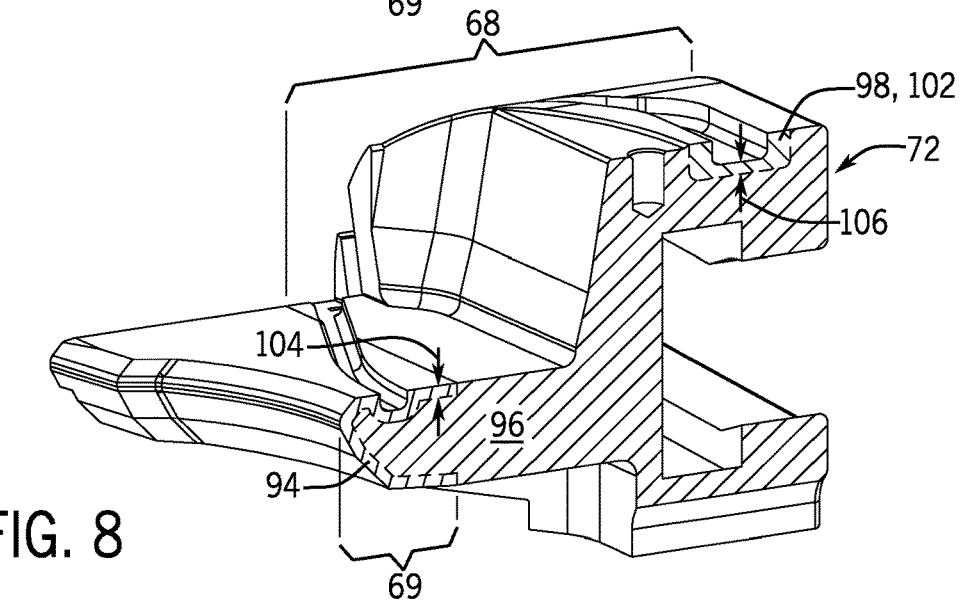

In some embodiments, the boundaries that define the diffusion bonds between different metal alloys may be complex and correspond to (e.g., follow, match) one or more contours in the outer surface of the pressure-controlling components 26. For example, FIG. 8 is a cross-sectional view of an embodiment of a substantially trimetallic lower ram 50B having boundaries 100 that follow along features defined in the outer surface of the part. In particular, a layer of the first metal alloy 94 defines the outer surface of the blade section 69 of the part, while the second metal alloy 96 fills the interior of the blade section 69 and defines the outer surface of the body section 68 of the ram 50B. Additionally, for the illustrated embodiment, the third metal alloy 98 (e.g., a corrosion resistant alloy) defines the outer surface of a seal region 102 in the body section 68 of the ram 50B. It should be appreciated that any of the boundaries 100 (e.g., planar, curved, complex) may be used in the upper ram 50A, the low ram 50B, or both in any suitable combination (e.g., all planar, all curved, at least one planar and at least one curved).

For certain embodiments of the lower ram 50B illustrated in FIG. 8, at least a portion of the first metal alloy 94 or the third metal alloy 98 may be disposed on the second metal alloy 96 to form the outer surfaces of the pressure-controlling components 26 using a welding-based deposition process (e.g., an overlay, inlay, or cladding process) after the formation of the remainder of the part using the HIP manufacturing process set forth below. However, in some embodiments, all of the metal alloys (e.g., metal alloys 94, 96, and 98) of the pressure-controlling component 26 are joined together during the HIP manufacturing process discussed below. For example, the layer of the first metal alloy 94 may have a defined first thickness 104 in the blade section 69 of the part, while the third metal alloy 98 may have a second thickness 106 in the seal region 102 of the ram 50B. Using the disclosed HIP manufacturing process, the first and second thicknesses 104 and 106 may be independently controlled to any suitable thickness, such as 0.125 inch (in) (0.3157 centimeter (cm), about 3 millimeters (mm)) or greater, 0.25 in (0.635 cm, about 6 mm) or greater, 0.375 in (0.9525 cm, about 10 mm) or greater, between 0.125 in (0.3157 cm, about 3 mm) and 1 in (2.54 cm, about 25 mm), between 0.25 in (0.635 cm, about 6 mm) and 1 in (2.54 cm, about 25 mm), 1 in (2.54 cm, about 25 mm) or greater. As such, it may be appreciated that, for embodiments in which the metal alloys of the pressure-controlling components 26 are joined during HIP process in the disclosed HIP manufacturing process, there is an advantageous reduction in manufacturing time and cost by avoiding the welding-based deposition processes, as well as any subsequent post-welding activity (e.g., clean-up, analysis, inspection). By using the disclosed HIP manufacturing process, the thicknesses 104 and 106 of the metal alloy layers 94 and 98 can also reach substantially greater thicknesses than can be suitably deposited using welding-based deposition processes. Additionally, since the HIP manufacturing process does not require depositing the metal alloys 94 and 98 via a welding-based process, metal alloys 94, 96, and 98 may be metal alloys that are less conducive or completely incompatible with welding-based processes. Furthermore, by avoiding the welding-based processes, the potential to introduce issues in the part as a side-effect of the welding-based deposition processes (e.g., unintended thermally-induced changes in the grain structure at or near the weld deposit, unintended introduction of stress or strain in the part, unintended imperfections in the fusion zone) can also be advantageously avoided.

Figure 9:
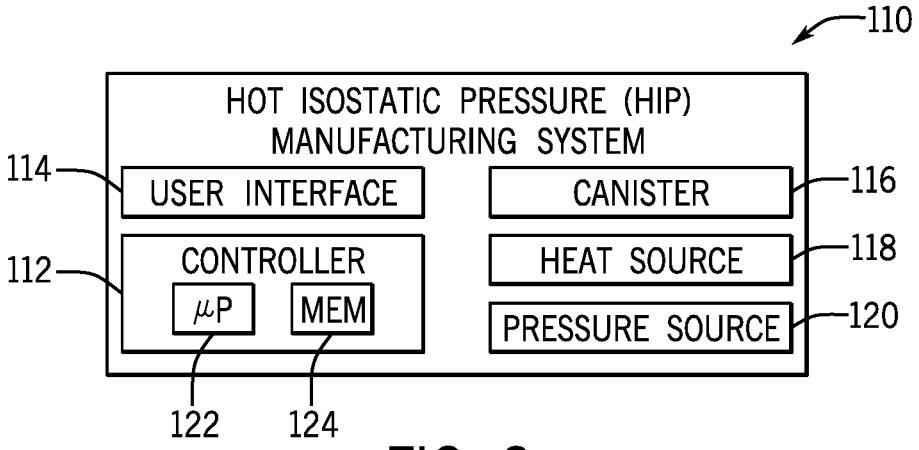
FIG. 9 is a block diagram of a hot isostatic pressure (HIP) manufacturing system that is configured to carry out a HIP manufacturing process to fabricate the components of FIGS. 3 and 4, in accordance with an embodiment of the present disclosure.

FIG. 9 is a block diagram of an embodiment of a HIP manufacturing system 110 that may be used to construct the multi-metallic pressure-controlling component 26 (e.g., the upper ram 50A, the lower ram 50B, other components of the BOP 24). For the illustrated embodiment, the HIP manufacturing system 110 includes a controller 112, a user interface 114, a canister 116, a heat source 118, and a pressure source 120, which, as discussed below, may be used to carry out the steps of the manufacturing process 130 of FIG. 10 to form the pressure-controlling component 26.

In certain embodiments, the controller 112 is an electronic controller having electrical circuitry configured to process data from various components of the system 110, for example. In the illustrated embodiment, the controller 112 includes a processor 122 and a memory device 124. The controller 112 may also include one or more storage devices and/or other suitable components. By way of example, the processor 122 may be used to execute software, such as software for controlling the user interface 114, controlling the heat source 118, the pressure source 120, and so forth.

Moreover, the processor 122 may include multiple microprocessors, one or more "general-purpose" microprocessors, one or more special-purpose microprocessors, and/or one or more application specific integrated circuits (ASICS), or some combination thereof. For example, the processor 122 may include one or more reduced instruction set (RISC) processors.

The memory device 124 may include a volatile memory, such as random access memory (RAM), and/or a nonvolatile memory, such as read-only memory (ROM). The memory device 124 may store a variety of information and may be used for various purposes. For example, the memory device 124 may store processor-executable instructions (e.g., firmware or software) for the processor 122 to execute, such as instructions for controlling the user interface 114, the heat source 118, the pressure source 120, and so forth. The storage device(s) (e.g., nonvolatile storage) may include read-only memory (ROM), flash memory, a hard drive, or any other suitable optical, magnetic, or solid-state storage medium, or a combination thereof.

The user interface 114 may include suitable input and output devices communicatively coupled to the controller 112. The user interface 114 is configured to receive user input defining parameters of the HIP manufacturing process (e.g., temperature/pressure programs). The controller 112 may store received inputs in the memory device 124 until used by the processor 122 to perform portions of the HIP manufacturing process. During the HIP manufacturing process, information about the state of the controller 112, the heat source 118, the pressure source 120, and measurements from various sensors (e.g., temperature sensors, pressure sensors, displacement sensors) of the HIP manufacturing system 110 may be suitably presented on a display device of the user interface 114.

The canister 116 is generally a sacrificial metal alloy (e.g., steel) container that serves as a mold during the HIP processing. As such, the canister 116 includes an internal cavity that generally corresponds to the shape of the pressure-controlling component 26 being manufactured, although notably larger due to the reduction in volume experienced during HIP process. As discussed below, the canister 116 is designed to receive multiple metal alloy powders, and potentially receive metal alloy foil boundary layers (e.g., nickel foil boundary layers) that are disposed between each layer of distinct metal alloy powder. During HIP processing of the canister 116, the pressure provided by the pressure source 120 and the heat provided by the heat source 118 condenses the materials (e.g., metal alloy powders, boundary layers) within the canister 116 into an integral, dense, multi-metallic pressure-controlling component 26. In certain embodiments, the heat source 118 and the pressure source 120 are integrated into a single element (e.g., an autoclave furnace).

Figure 10:
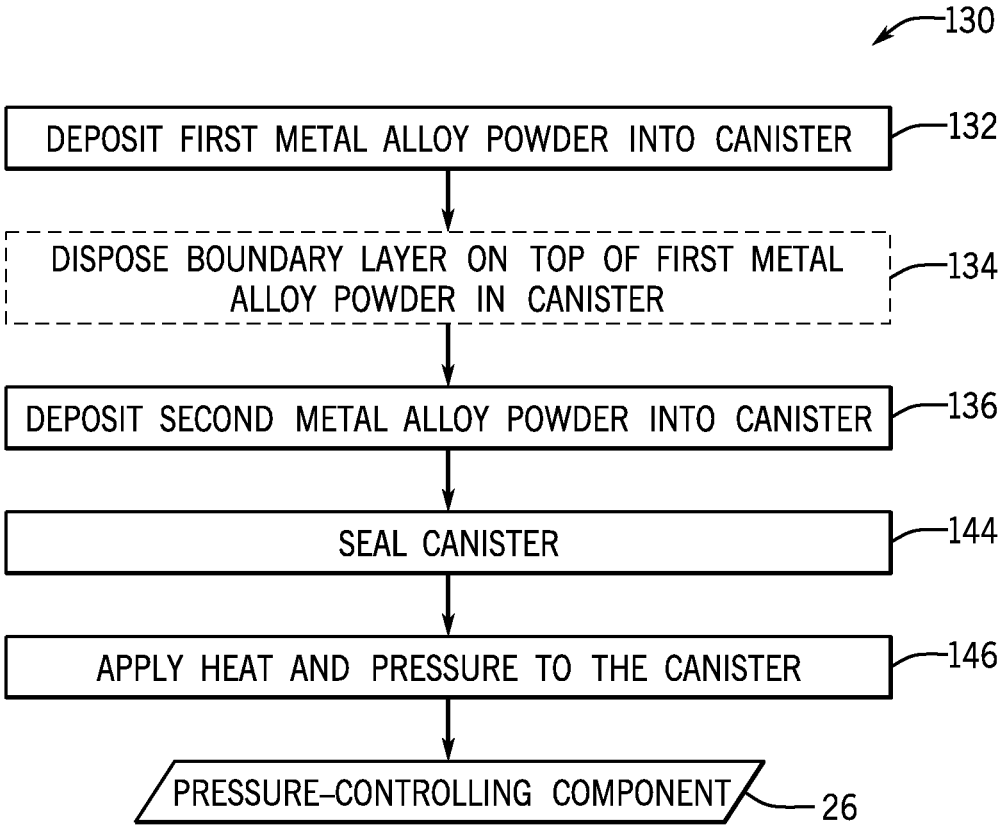
FIG. 10 is a flow diagram of the HIP manufacturing process, in accordance with an embodiment of the present disclosure.

With the foregoing in mind, FIG. 10 is a flow diagram of a process 130 for manufacturing the pressure-controlling component 26 (e.g., the upper ram 50A, the lower ram 50B, other components of the BOP 24). In particular, the process 130 includes steps for constructing the pressure-controlling component 26 using the HIP manufacturing system 110 illustrated in FIG. 9. In certain embodiments, at least a portion of the steps of the process 130 (e.g., loading of the canister) may be performed by a human operator, while at least a portion of the steps of the process 130 (e.g., HIP processing) may be performed by the controller 112 based on instructions stored in the memory device 124 and/or input received from the user interface 114. It may be appreciated that the process 130 is merely provided as an example, and in some embodiments, the process 130 may include additional steps, omitted steps, repeated steps, and so forth, in accordance with the present disclosure.

For the embodiment illustrated in FIG. 10, the process 130 begins with depositing (block 132) a first metal alloy powder into the canister 116. The first metal alloy may be any of a variety of suitable materials, including those mentioned above. In certain embodiments, the first metal alloy added to the canister 116 may correspond to the metal alloy that forms at least a substantial portion of the body section 68 of the rams 50 (e.g., metal alloy 96 in FIGS. 6 and 7). In some embodiments, the first metal alloy powder added into the canister 116 may correspond to the metal alloy that will be disposed nearest the rearward surface 72 of the part (e.g., metal alloy 98 in FIG. 5) or nearest the leading surface 70 of the part (e.g., metal alloy 94 in FIG. 5), depending on the orientation of the part in the canister 116. In certain embodiments, adding the first metal alloy powder into the canister 116 may include packing or shaping the powder, for example, using vibration, tamping, or other suitable methods. In certain embodiments, the metal alloy powder may be stored under inert atmosphere (e.g., nitrogen, helium, argon, an oxygen-depleted atmosphere) and/or the canister may be loaded under an inert atmosphere to block oxidation of the surface of the metal alloy powder.

Continuing through the embodiment illustrated in FIG. 10, the process 130 continues with disposing (block 134) a boundary layer on top of the first metal alloy layer in the canister 116. Subsequently, a second metal alloy powder is deposited (block 136) into the canister 116, above the first metal alloy layer in the canister 116 and above the boundary layer (when present). In certain embodiments, a boundary layer may not be used and the actions of block 134 may be skipped.

As mentioned, the boundary layer is a thin piece of a metal alloy (e.g., a metallic foil, a flat sheet) that may be disposed between layers of different metal alloy powders to prevent mixing of the powders during placement within the canister prior to carrying out the HIP processing and/or in the part after the HIP processing, which may enable a sharp and well-defined boundary between the different metal alloy powders and/or facilitate bonding. In certain embodiments, the boundary layer may have a composition that is the same as, or similar to, one of the metal alloy powders it separates. In some embodiments, the boundary layer may have a composition that is different than the composition of the metal alloy powders separated by the boundary layer. For example, the boundary layer may serve as a "butter layer" to facilitate the formation of a strong bond between the metal alloy powder layers. That is, the boundary layer may be a metal alloy that is more conducive towards bonding with the first and second metal alloy powders than the first and second metal alloy powders are toward bonding directly with each other. In some embodiments, the actions of blocks 134 and 136 may be repeated to add a third metal alloy, a fourth metal alloy, etc., to the canister 116 as desired.

Figure 11A:
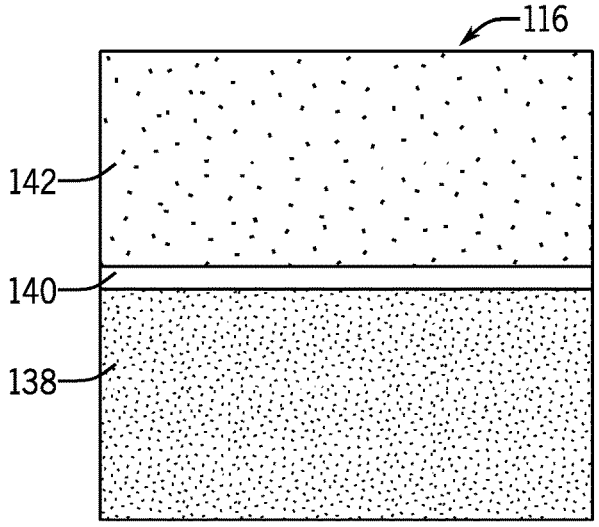
FIGS. 11A, 11B, and 11C are cross-sectional views of portions of a loaded canister prior to a HIP process of the HIP manufacturing process, in accordance with an embodiment of the present disclosure.
Figure 11B:
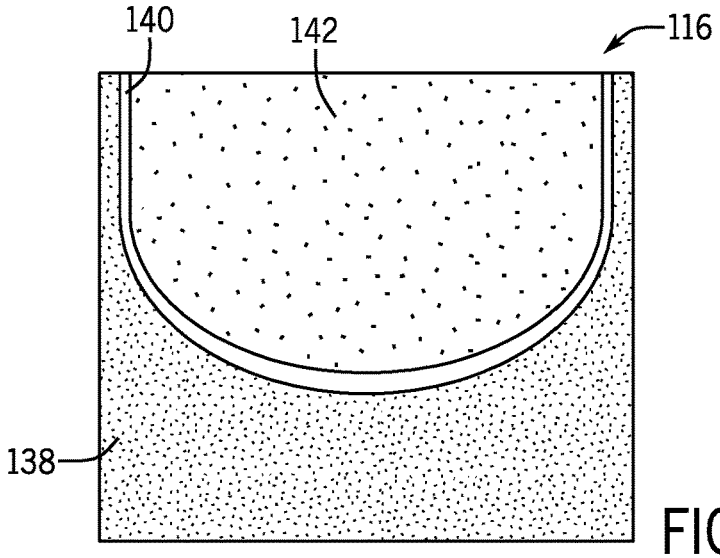
Figure 11C:
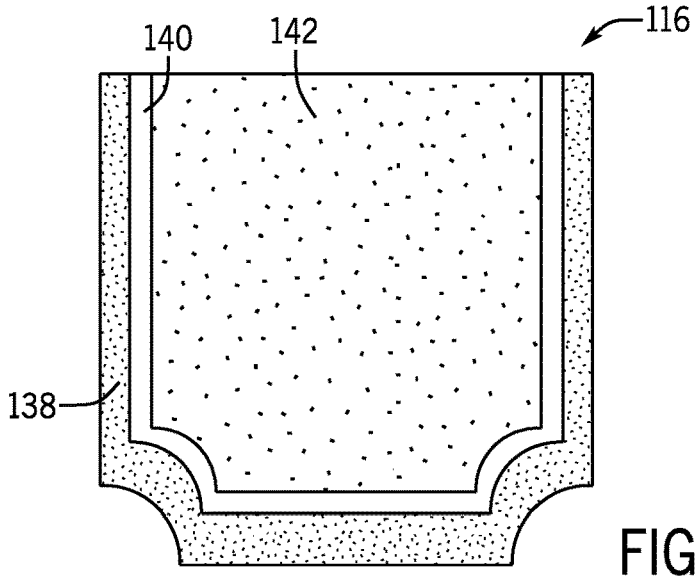

The actions of blocks 132, 134, and 136 may be better understood by way of FIGS. 11A-C. These figures illustrate cross-sectional views of portions of the canister 116 loaded with a first layer 138 of a first metal alloy powder (as set forth in block 132), a boundary layer 140 (as set forth in block 134), and a second layer 142 of a second metal alloy powder (as set forth in block 136). As shown in FIG. 11A, in certain embodiments, the boundary layer 140 may provide a substantially flat interface separating the two planar layers of metal alloy powder 138 and 142, which results in a flat planar boundary 100 in the pressure-controlling component 26, as illustrated and discussed above with respect to FIG. 5. As shown in FIG. 11B, in certain embodiments, the boundary layer 140 may provide a curved interface separating the two layers of metal alloy powder 138 and 142, which would result in a curved boundary 100 in the pressure-controlling component 26, as illustrated and discussed above with respect to FIGS. 5 and 6. As shown in FIG. 11C, in certain embodiments, the boundary layer 140 may have a shape that corresponds to one or more features of the canister 116 (and eventually to the features on an outer surface of the pressure-controlling component 26) to provide a complex interface separating the two layers of metal alloy powder 138 and 140, which would result in a complex boundary 100 in the pressure-controlling component 26, as illustrated and discussed above with respect to FIG. 8.

Returning to FIG. 10, the process 130 continues with sealing the canister 116 (block 144). For example, in certain embodiments, the canister 116 is placed under vacuum (e.g., to remove ambient oxygen) and then welded closed. Once sealed, heat and pressure are applied (block 146) to the materials (e.g., metal alloy powders, metal alloy boundary layers) disposed within the canister to consolidate the materials to form the pressure-controlling component 26 in a HIP process. For example, heat and pressure may be applied to the canister 116 via the heat source 118 and the pressure source 120 (e.g., an autoclave furnace), and the walls of the canister 116 impart the desired heat and pressure to the materials within the canister 116. The heat and pressure cause the materials within the canister 116 to condense and bond to one another. More specifically, each of the powdered metal alloys may sinter together to form portions of the component 26, while narrow (e.g., 1 millimeter or less) diffusion bonds form at the boundaries 100 between the different metal alloys. In other words, there is only a limited amount of mixing of the metal alloys of the two metal alloy powders and/or mixing of the metal alloys with the boundary layer at the interfaces 100, and there is no substantial mixing of the metal alloys and/or the boundary layer a short distance (e.g., 1 millimeter) outside of each of these boundaries.

In certain embodiments, the materials sealed within the canister 116 may be heated to approximately 1050 to 1100 degrees Celsius, and the hydrostatic pressure within the canister may be approximately 400 to 450 Megapascals. However, any suitable temperature and/or pressure may be utilized to cause formation of the pressure-controlling component 26. For example, in some embodiments, the temperature may be between approximately 900 to 1200, 950 to 1150, or 1000 to 1100 degrees Celsius and/or the pressure may be approximately 300 to 600, 350 to 550, or 400 to 500 Megapascals. In certain embodiments, the temperature and/or the pressure may be varied at different times during HIP processing as part of a temperature/pressure program, for example, with various ramps to increase or decrease the temperature and/or pressure over predefined time windows, and with various holds times during which the temperature and/or pressure are held substantially constant. It may be appreciated that the particular temperatures and pressures used in the HIP process of block 146 may be selected based on the material properties (e.g., melting point, sintering point) of the powder metal alloys and boundary layers disposed within the canister 116. It may be noted that there is a substantial reduction in volume (e.g., between 15 percent and 25 percent, about 20 percent) of the materials disposed within the canister 116 during this HIP process. Upon completion of the HIP process of block 146, the pressure-controlling component 26 is subsequently removed from the canister 116. The resulting pressure-controlling component 26 may have a substantially uniform density (e.g., plus or minus 10 percent, plus or minus 5 percent) and/or the various regions of the component 26 with different metal alloys may be coupled to one another via narrow diffusion bonds. In certain embodiments, the pressure-controlling component 26 may undergo additional processing steps (e.g., machining, welding overlays, thermal treatment) to yield the final part.

The disclosed techniques enable the HIP fabrication of multi-metallic (e.g., bimetallic, trimetallic) pressure-controlling components for pressure-controlling equipment used in oil and gas applications. The disclosed HIP manufacturing process enables multiple, distinct metal alloys to be used to form particular portions of a pressure-controlling component, wherein the different metal alloys can be joined using a single HIP process. Compared with traditional subtractive manufacturing techniques, the disclosed HIP manufacturing process reduces the manufacturing time and cost, enables greater freedom of design in the selection of metal alloys, and enables a broader range of different material properties (e.g., strength, toughness, corrosion resistance) in different portions of the pressure-controlling component. Additionally, the disclosed HIP manufacturing technique can enable the formation of surface layers of metal alloy at thicknesses not achievable using weld-based processes (e.g., inlaying, overlaying, cladding) and using metal alloys that are not conducive to welding-based processes.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The invention claimed is:

1. A multi-metallic ram for a blowout preventer (BOP), the multi-metallic ram comprising:

a first portion formed from a first metal alloy;

a second portion formed from a second metal alloy;

a metal boundary layer present along an interface between the first metal alloy and the second metal alloy to enable the first metal alloy to form opposed exterior surfaces of a first section of the multi-metallic ram, and to enable the second metal alloy to form an interior in the first section between the opposed exterior surfaces of the first section of the multi-metallic ram, wherein the second metal alloy defines an outer surface of a second section of the multi-metallic ram; and a diffusion bond at the interface between the first metal alloy and the second metal alloy that joins the first metal alloy to the second metal alloy within the multi-metallic ram.

2. The multi-metallic ram of claim 1, wherein the first metal alloy and the second metal alloy are independently selected from the group consisting of: chromium-molybdenum (Cr—Mo) steels, chromium-nickel-molybdenum (Cr—Ni—Mo) steels, maraging steels, super martensitic stainless steels, precipitation-hardened nickel alloys, precipitation-hardened martensitic steels, solution-annealed nickel alloys, tool steels, cobalt-bound tungsten-carbides, nickel-bound tungsten-carbides, nickel-cobalt (Ni—Co) alloys, and cobalt-chromium (Co—Cr) alloys.

3. The multi-metallic ram of claim 1, wherein the diffusion bond has a thickness of 1 millimeter or less, and there is no substantial mixing of the first metal alloy and the second metal alloy outside of the diffusion bond.

4. The multi-metallic ram of claim 1, wherein a grain structure of the first metal alloy and of the second metal alloy is substantially homogenous near the diffusion bond.

5. The multi-metallic ram of claim 1, wherein the interface between the first metal alloy and the second metal alloy is planar.

6. The multi-metallic ram of claim 1, wherein the interface between the first metal alloy and the second metal alloy is curved.

7. The multi-metallic ram of claim 1, wherein the interface between the first metal alloy and the second metal alloy has contours that correspond to non-planar features disposed on an outer surface of the multi-metallic ram.

8. The multi-metallic ram of claim 1, wherein each of the opposed exterior surfaces formed from the first metal alloy has a thickness greater than about 3 millimeters.

9. The multi-metallic ram of claim 1, wherein the multi-metallic ram is devoid of welds between the first metal alloy and the second metal alloy.

10. A multi-metallic ram for a blowout preventer (BOP), comprising:

a blade section formed from a first metal alloy;

a body section formed from a second metal alloy;

a metal boundary layer present along an interface between the first metal alloy and the second metal alloy to enable the first metal alloy to form opposed exterior surfaces of a first section of the multi-metallic ram, and to enable the second metal alloy to form an interior in the first section between the opposed exterior surfaces of the first section of the multi-metallic ram, wherein the second metal alloy defines an outer surface of a second section of the mulit-metallic ram; and a diffusion bond disposed at the interface between the first metal alloy and the second metal alloy that joins the first metal alloy to the second metal alloy within the multi-metallic ram.

11. The multi-metallic ram of claim 10, wherein the blade section has a tensile strength, a yield strength, or a combination thereof, that is at least 5 percent greater than that of the body section of the multi-metallic ram.

12. The multi-metallic ram of claim 11, wherein the tensile strength, the yield strength, or a combination thereof, of the blade section is at least 200 percent greater than that of the body section of the multi-metallic ram.

13. The multi-metallic ram of claim 10, wherein the body section has a percent elongation or a percent reduction in area at least 5 percent greater than that of the blade section of the multi-metallic ram.

14. The multi-metallic ram of claim 10, wherein the body section comprises a region formed from a third metal alloy, and the multi-metallic ram comprises a second diffusion bond disposed along a respective interface between the second metal alloy and the third metal alloy that joins the second metal alloy to the third metal alloy within the multi-metallic ram.

15. The multi-metallic ram of claim 14, wherein the region comprises a seal region of the multi-metallic ram configured to contact an elastomer seal, and the third metal alloy has a higher corrosion resistance than the second metal alloy.

16. The multi-metallic ram of claim 14, wherein the region comprises a slide region of the multi-metallic ram configured to contact and slide against another metal component of the BOP during operation, and the third metal alloy has a hardness that is at least 5 percent greater than that of the second metal alloy.

17. A multi-metallic ram for a blowout preventer (BOP), the multi-metallic ram comprising:

a blade portion formed from a first metal alloy;

a body portion formed from a second metal alloy and coupled to the first portion;

a metal boundary layer present along an interface between the first metal alloy and the second metal alloy to enable the first metal alloy to form opposed exterior surfaces of a first section of the multi-metallic ram, and to enable the second metal alloy to form an interior in the first section between the opposed exterior surfaces of the first section of the multi-metallic ram, wherein the second metal alloy defines an outer surface of a second section of the multi-metallic ram; and wherein the interface that joins the first metal alloy to the second metal alloy within the multi-metallic ram is devoid of welds.

* * * * *